US008354878B2

(12) United States Patent
Petenyi

(10) Patent No.: US 8,354,878 B2
(45) Date of Patent: Jan. 15, 2013

(54) INTEGRATED ELECTRONIC DEVICE WITH REFERENCE VOLTAGE SIGNAL GENERATION MODULE AND UVLO LOGIC SIGNAL GENERATION MODULE

(75) Inventor: Sandor Petenyi, Milovice Nad Labem (CS)

(73) Assignee: STMicroelectronics Design and Application S.R.O., Prague (CZ)

( * ) Notice: Subject to any disclaimer, the term of this patent is extended or adjusted under 35 U.S.C. 154(b) by 168 days.

(21) Appl. No.: 12/976,587

(22) Filed: Dec. 22, 2010

(65) Prior Publication Data

US 2011/0148483 A1 Jun. 23, 2011

(30) Foreign Application Priority Data

Dec. 23, 2009 (IT) ..... MI2009A2277

(51) Int. Cl.
*G05F 1/10* (2006.01)

(52) U.S. Cl. ..... 327/540; 327/143; 327/198; 327/205

(58) Field of Classification Search ..... 327/142, 327/243, 198, 205, 206, 539, 540, 143
See application file for complete search history.

(56) References Cited

U.S. PATENT DOCUMENTS

| | | | | |
|---|---|---|---|---|
| 5,814,995 | A | 9/1998 | Tasdighi | 324/431 |
| 6,600,639 | B1 | 7/2003 | Teo et al. | 361/92 |
| 7,570,091 | B2 * | 8/2009 | Sugio | 327/143 |
| 7,873,856 | B2 * | 1/2011 | Westwick et al. | 327/539 |
| 7,969,211 | B2 * | 6/2011 | Huang | 327/143 |

FOREIGN PATENT DOCUMENTS

| | | |
|---|---|---|
| DE | 102006061512 | 6/2008 |
| EP | 0733959 | 9/1996 |

* cited by examiner

*Primary Examiner* — Long Nguyen
(74) *Attorney, Agent, or Firm* — Allen, Dyer, Doppelt, Milbrath & Gilchrist, P.A.

(57) ABSTRACT

An electronic integrated device may include a signal generation stage arranged to generate a first signal representative of an under voltage lockout logic signal. The signal generation stage may include a voltage divider block arranged to provide an internal reference voltage signal to a bandgap core group based upon a reference signal. The bandgap core group may generate the first signal based upon the internal reference voltage signal. The bandgap core group may further include a first generation module arranged to generate a output regulated reference voltage signal based upon the internal reference voltage signal, and a second generation module arranged to generate the first signal based upon the internal reference voltage signal and a driving signal obtained by a preliminary processing of the internal reference voltage signal by a bandgap core module included within the band gap core group.

27 Claims, 3 Drawing Sheets

INTEGRATED ELECTRONIC DEVICE WITH REFERENCE VOLTAGE SIGNAL GENERATION MODULE AND UVLO LOGIC SIGNAL GENERATION MODULE

FIELD OF INVENTION

The present invention relates to the field of integrated circuit design. More particularly, the present invention relates to an electronic integrated device with reference voltage generation circuit and under voltage lockout (UVLO) logic signal generation circuit.

BACKGROUND OF THE INVENTION

Almost every electronic system needs a precise reference value generator to set the operating conditions and to meet the precision needs. Such a reference generator may provide a stable and precise reference value independent of the operating conditions, like supply voltage, temperature and time. Because modern electronic systems are converging to very low supply voltage levels, the reference generator also has to deal with this requirement.

Today, one reference generator most often used in integrated circuits is the so-called bandgap reference voltage generator. As may be known, such bandgap reference voltage generator provides a reference voltage with a very low temperature coefficient balanced within the operating temperature range. The bandgap reference voltage generator may generate a very precise absolute value inside the chip by using imprecise and strongly temperature dependent components.

As the electronic system tends to work at very low supply voltage levels close to the technology limits, the information about the supply voltage status becomes relatively very important. A reliable and stable supply may be one of the most important prerequisites for the reliable operation. Particularly, a significant role may be played by the steady state, and also by the supply start-up and shutdown waveforms.

To allow the integrated device to deal with various supply levels and transitions, it may be good practice to lock its operation until the supply is not at sufficient level. This may be achieved by an under voltage lockout (UVLO) logic signal generation circuit that senses the supply voltage levels and gives logical information to the system.

This measure may reduce some unneeded and often unpredictable effects, like oscillations, overshooting, peaking in analog circuits, and digital information loss in digital circuits.

Different approaches addressing the reference voltage generation and UVLO function exist. As indicated above, a majority of the reference voltage generators is typically based on the bandgap principle. An integrated electronic device of the prior art comprising an under voltage lockout signal generator circuit is disclosed in U.S. Pat. No. 6,600,639. Such an integrated electronic device of the prior art has the drawbacks of increasing of the chip area because the need of a two bandgap core, a first bandgap core to be used in the reference voltage generator circuit, and a second bandgap core to be used in the under voltage lockout signal generator circuit, usually present on the same chip.

SUMMARY OF THE INVENTION

The object of the present invention is to provide an integrated electronic device which allows the above indicated drawbacks of the cited prior art to be overcome, and, particularly, which includes a lower chip area, thus increasing reliability and simplicity. Such object is achieved by an integrated electronic device according to the attached claims.

BRIEF DESCRIPTION OF THE DRAWINGS

Further characteristics and advantages of the device according to the invention will result from the description reported below of preferred exemplary embodiments, given by way of non-limiting, indicative example, with reference to the annexed Figures, in which.

DETAILED DESCRIPTION OF THE PREFERRED EMBODIMENTS

Figure 1:
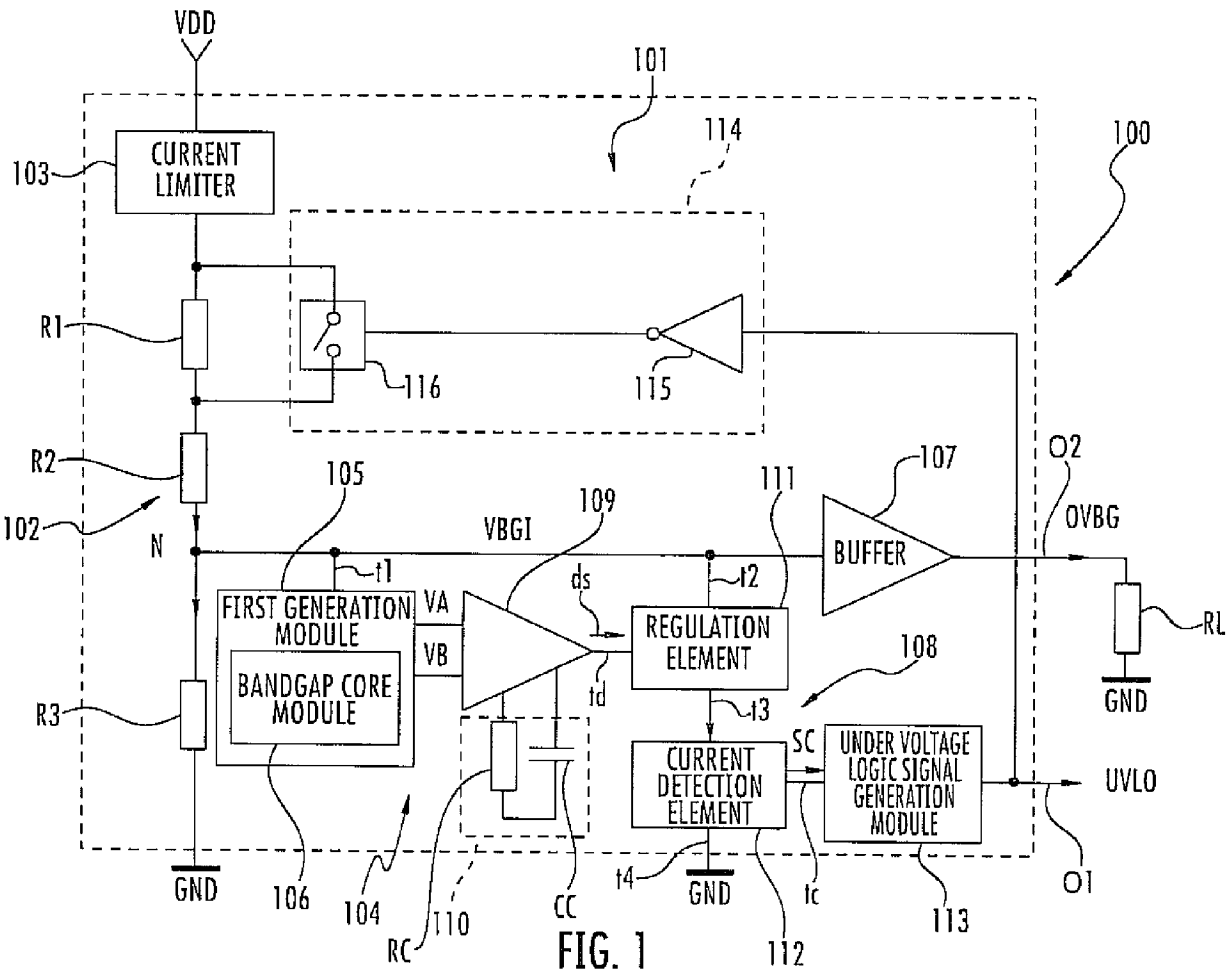
FIG. 1 schematically illustrates an integrated electronic device according to an example of the present invention.

With reference to FIG. 1, an integrated electronic device 100 is now described, hereinafter also device 100, according to an example embodiment. The device 100 is arranged to generate an under voltage lockout logic signal UVLO and an output regulated reference voltage signal OVBG based upon an input signal (e.g. the supply voltage VDD). The device 100 comprises a signal generation stage 101 arranged to generate a first signal UVLO representative of an under voltage lockout logic signal.

In FIG. 1 the signal generation stage 101 is representative of a portion of the integrated electronic device 100 limited by a block having its outline in broken lines. In more detail, the signal generation stage 101 comprises a first output terminal 01 to provide the first signal UVLO to other electronic stages of the integrated electronic device 100, or other integrated electronic devices of an electronic system in which the device 100 is included.

The signal generation stage 101 comprises a voltage divider block 102 operatively connected between a first reference signal VDD, for example, the supply voltage, and a second reference signal GND, for example, the ground. An example of voltage divider block 102 will be described in the following.

The first reference signal VDD (supply voltage) may be considered also as an reference signal, or input signal of the integrated electronic device 100. The signal generation stage 101 further comprises a current limiter block 103, as may be known, operatively connected in series with the voltage divider block 102. Particularly, the current limiter block 103 is disposed between the first reference signal VDD and the voltage divider block 102.

The current limiter block 102 is arranged to limit the amount of current driven by the voltage divider block 102 at an increasing of the first reference signal VDD lead through the current limiter block 103 and the voltage divider block 102. Furthermore, the current limiter block 103 is advantageously arranged to provide a current limiter value set to reduce impact on the ratio of the voltage divider block 102 around the under voltage lockout logic signal detection, as will be explained later. An example of current limiter block is a current mirror (not shown in the figures), which may be known.

The voltage divider block 102 is arranged to provide an internal reference voltage signal VBGI to a bandgap core group 104, included in the signal generation stage 101, based upon the first reference signal VDD. It should be noted that the reference voltage signal VBGI is defined as "internal" because it is a reference voltage signal generated within the integrated electronic device 100, particularly, generated by the voltage divider block 102.

As also shown in the example of FIG. 1, the voltage divider block 102 comprises a first resistor R1, a second resistor R2, and a third resistor R3 operatively connected in series between the current limiter block 103 and the second reference signal GND. The internal reference voltage signal VBGI, provided by the voltage divider block 102, is the voltage of the node N interposed between the second resistor R2 and the third resistor R3.

The bandgap core group 104 of the signal generation stage 101 comprises an input terminal t1 operatively connected to the node N of the voltage divider block 102 to receive the internal reference voltage signal VBGI. The bandgap core group 104 is arranged to generate the first signal UVLO representative of the under voltage lockout logic signal based upon the internal reference voltage signal VBGI.

Furthermore, the bandgap core group 104 comprises a first generation module 105 arranged to generate an output regulated reference voltage signal OVBG based upon the internal reference voltage signal VBGI. In more detail, the first generation module 105 is arranged to provide the output regulated reference voltage signal OVBG on a second output terminal 02 of the signal generation stage 101 to provide the output regulated voltage signal voltage OVBG to other load electronic devices connected to the device 100.

In the example of FIG. 1, the second output terminal O2 of the signal generation stage 101 is operatively connected to a DC load RL. The first generation module 105 comprises a bandgap core module 106 having an input terminal corresponding to the input terminal t1 of the bandgap core group 104. The first generation module 105 further comprises a buffer element 107 having an input terminal operatively connected to node N of the divider voltage block 102 (input terminal t1), and on output terminal corresponding to the second output terminal O2 of the signal generation stage 101.

It should be noted that the buffer element 107 is advantageously employed in the case, shown in the example in FIG. 1, in which the output second terminal O2 is connected to the DC load RL to reduce the impact of the internal reference voltage signal VBGI and the error of the under voltage lockout logic signal detection. An example of a buffer element 107 is an operational amplifier, which may be known. An example of bandgap core module 106, which may be known, will be described later with reference to FIG. 2.

Turning back again to FIG. 1, the bandgap core group 104 further comprises a second generation module 108 arranged to generate the first signal UVLO based upon the internal reference voltage signal VBGI and a driving signal ds obtained by a preliminary processing of the internal reference voltage signal VBGI by the bandgap core module 106 included in the bandgap core group 104. More particularly, the second generation module 108 comprises an operational amplifier 109 operatively connected to the bandgap core module 106.

Particularly, the bandgap core module 106 comprises a first output terminal VA and a second output terminal VB operatively connected with a first input terminal and a second input terminal, respectively, of the operational amplifier 109. The operational amplifier 109 is arranged to provide, on its output terminal, the driving signal ds.

The second generation module 108 further comprises, preferably, a compensation block 110 operatively connected to the operational amplifier 109 in a feedback loop. In the example of the FIG. 1, the compensation block 110 comprises a compensation resistor RC and a compensation capacitor CC electrically connected in series.

Figure 2:
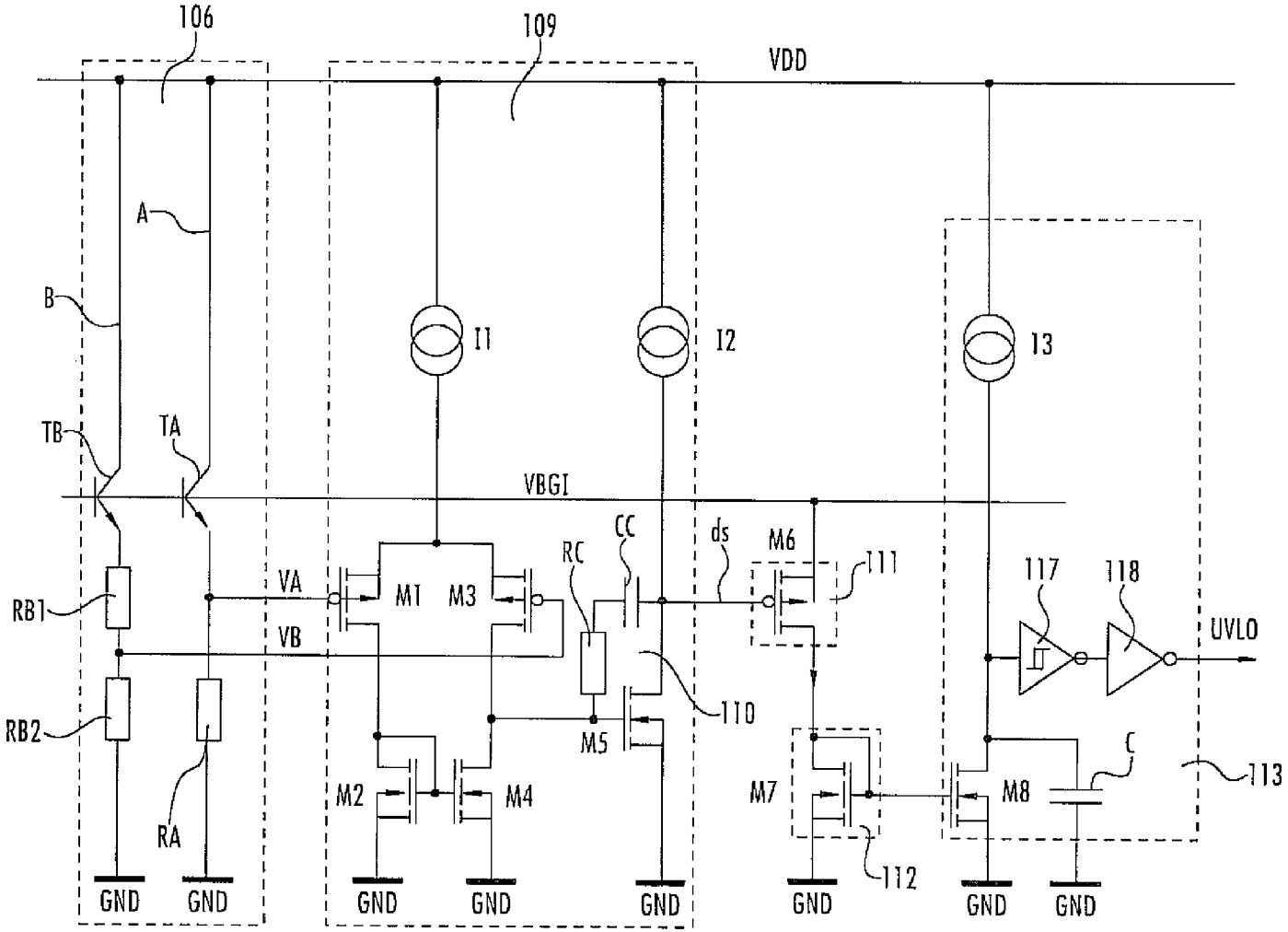
FIG. 2 schematically illustrates a portion of the integrated electronic device of FIG. 1.

As illustrated FIG. 2, the bandgap core module 106 comprises a first transistor TA, for example, a bipolar type, and a second transistor TB, for example, a bipolar type, arranged in an emitter follower configuration, as may be known. Particularly, the bandgap core module 106 comprises a first current branch A comprising the first transistor TA. The first transistor TA has a collector terminal connected to the first reference signal VDD, and an emitter terminal connected to the second reference signal GND via a first polarization resistor RA.

The bandgap core module 106 further comprises a second current branch B comprising the second transistor TB. Such second transistor TB has a collector terminal connected to the first reference signal VDD, and an emitter terminal connected to the second reference signal GND via further polarization resistors RB1 and RB2 electrically connected in series. The base terminal of the first transistor TB1 and the base terminal of the second transistor TB2 are operatively connected to the voltage divider block 102 (not shown in FIG. 2) to receive the internal reference voltage signal VBGI.

In view of this, the bandgap core module 106 advantageously has a high input impedance to reduce the voltage divider block load and error. The voltage level provided on the first output terminal VA of the bandgap core module 106 is the voltage level of the emitter node of the first transistor TA. The voltage level provided on the second output terminal VB of the bandgap core module 106 is the voltage level of the node interposed between the further resistors RB1 And RB2.

The operational amplifier 109, as shown in the example of FIG. 2, comprises a complimentary metal oxide semiconductor (CMOS) amplifier with a current mirror load, as may be known. Particularly, the operational amplifier 109 comprises a first MOS transistor M1 of a p-channel type having: a gate terminal connected to the first output terminal VA of the bandgap core module 106 to receive the first voltage level VA; a source terminal connected to the first reference signal VDD via a first polarization current generator I1; and a drain terminal connected to the second reference signal GND via a second MOS transistor M2 of n-channel type arranged in a diode configuration.

The operational amplifier 109 comprises a third MOS transistor M3 of p-channel type having: a gate terminal connected to the second output terminal VB of the bandgap core module 106 to receive the second voltage level VB; a source terminal connected to the first reference signal VDD via the first polarization current generator I1; and a drain terminal connected to the second reference signal GND via a fourth MOS transistor M4 of n-channel hype having the gate terminal connected to the gate of the second MOS transistor M2.

The operational amplifier 109 further comprises a fifth MOS transistor M5 of n-channel type having: a gate terminal connected to the drain terminal of the third MOS transistor M3; the drain terminal connected to the first reference signal VDD via a second polarization current generator I2; and a source terminal connected to the second reference signal GND.

It should be noted that the components forming the operational amplifier are not limited just to MOS transistors. In alternative examples (not shown in the figures), transistors of a bipolar junction type may be used to build the operational amplifier to achieve relatively low noise performance of the reference signal. Transistors of the bipolar junction type may be preferably used inside the differential stage and in other stages.

The compensation resistor RC and the compensation capacitor CC of the compensation block 110 are disposed between the gate terminal and the drain terminal of the fifth MOS transistor M5. The voltage level of the source terminal of the fifth MOS transistor M5 is representative of the driving signal ds.

It should be noted that the internal reference voltage signal VBGI provided to the bandgap core module 106 influences its operating conditions, e.g. branch currents and first voltage level VA and second voltage level VB. Proper selection and sizing of components inside the bandgap core module 106 assures existence of an inflexion point representing a temperature balance condition. Equal values of the first voltage level VA and the second voltage level VB represent a balanced state of the bandgap core module 106 and a minimum temperature coefficient of the internal reference voltage signal VBGI.

Turning back to FIG. 1, the second generation module 108 further comprises a regulation element 111 having a input driving terminal td operatively connected to the output terminal of the operational amplifier 109 to receive from it, the driving signal ds. Moreover, the regulation element 111 comprises an first terminal t2 operatively connected to the node N of the voltage divider block 102 to receive the internal reference voltage signal VBGI and a second terminal t3.

The second generation module 108 further comprises a current detection element 112 having a first terminal, indicated as t3, operatively connected to the second terminal t3 of the regulation element 111. The current detection element 112 comprises a second terminal t4 operatively connected to the second reference signal GND. The current detection element 112 further comprises an output control terminal tc. The second generation module 108 further comprises an under voltage lockout (UVLO) logic signal generation module 113 having an input control terminal operatively connected to the output control terminal tc of the current detection element 112 and an output terminal corresponding to the first output terminal O1 of the signal generation stage 101 to provide the under voltage lockout logic signal UVLO.

Based upon the driving signal ds obtained by a preliminary processing of the input signal reference voltage UVLO by the bandgap core module 106 and the operational amplifier 109, the regulation element 111 is arranged to enable the flow of current from the node N having a voltage level corresponding to the internal reference voltage signal VBGI to the second reference signal GND, and thus through the current detection element 112.

Based upon the detection of the current from the node N and the second reference signal GND, the current detection element 112 is arranged to provide to the under voltage lockout logic signal generation module 113 a control signal sc. Based upon the control signal sc, the under voltage lockout logic signal generation module 113 is arranged to assume an unlocked state or a locked state providing, on its output terminal O1, a non-null voltage value, or a null voltage value, respectively. Thus, the integrated electronic device 100 of the invention is able to lock its operation until the supply voltage is not a sufficient level. The operation of the integrated electronic device 100 will be described later also with reference to FIG. 2.

Turning to FIG. 1, the signal generation stage 101 further comprises an hysteresis module 114 operatively connected as a positive feedback between the first output terminal O1 and the voltage divider block 102 to advantageously reduce possible glitches during the transition of the under voltage lockout logic signal UVLO between the lock state and the unlock state. In the example of FIG. 1, the hysteresis module 114 comprises an inverter block 115, as may be known, arranged to control, based upon the under voltage lockout logic signal UVLO, a switch element 116, as may be known, connected to the voltage divider block 102 to bypass the first resistor R1 based upon the under voltage lockout logic signal UVLO.

With reference now to FIG. 2, an example of regulation element 111, e.g. a switch element, is a sixth MOS transistor of a p-channel type having: a gate terminal connected to the drain terminal of the fifth MOS transistor M5 to receive the driving signal ds; a source terminal connected to the node N of the voltage divider block 102; and a drain terminal connected to the second reference signal GND via a seventh MOS transistor M7 of n-channel type arranged in a diode configuration.

The seventh MOS transistor M7 is an example of current detection element 112. Particularly, the seventh MOS transistor M7 has: a drain terminal connected to the drain terminal of the sixth MOS transistor M6; a source terminal connected to the second reference signal GND; and a gate terminal connected to the under voltage lockout logic signal generation module 113.

An example of under voltage lockout logic signal generation module 113 is shown in FIG. 2 and comprises a eighth MOS transistor MB of n-channel type having: a drain terminal connected to the first reference signal VDD via a third polarization current generator I3; a source terminal connected to the second reference signal GND; and a gate terminal connected to the second reference signal GND via a further capacitor C. It should be noted, that the seventh MOS transistor M7 and the eighth MOS transistor M8 are arranged in a current mirror configuration to provide the sixth MOS transistor M6 and seventh MOS transistor M7 the current provided by the third polarization generation current 13.

It should be noted that the ratio between the seventh MOS transistor M7 and the eighth MOS transistor M8 is advantageously relatively high (M7:M8~1:10) to achieve reduced under voltage lockout logic signal detection error. Thus, a very little current flows through the regulation element 111 to trigger the under voltage lockout logic signal generation module 113.

Moreover, it should be observed that the current of the eighth MOS transistor M8 is equal to the current provided by the third polarization current generator I3 just at the under voltage lockout logic signal turning point. Below the under voltage lockout logic signal threshold in the VDD upward direction, the eighth MOS transistor M8 sinks less current than the third polarization current generator I3 supplies so that it is in a dropout condition, and a potential level of the drain terminal of the eighth MOS transistor M8 is at the first reference signal VDD. Above the under voltage lockout logic signal threshold in the VDD upward direction, the eighth MOS transistor M8 sinks more current than the third polarization current generator I3 supplies so that the resulting current may be given by the third polarization current generator I3, and the potential level of the drain terminal of the eighth MOS transistor M8 goes to the second reference signal GND.

The under voltage lockout logic signal generation module 113 comprises a Schmitt trigger inverter 117, as may be known, having an input terminal connected to drain terminal of the eighth MOS transistor M8 and an output terminal connected to the input terminal of a further inverter block 118, as may be known. The output terminal of the further inverter block 118 is the first output terminal O1 of the signal generation stage.

Figure 3:
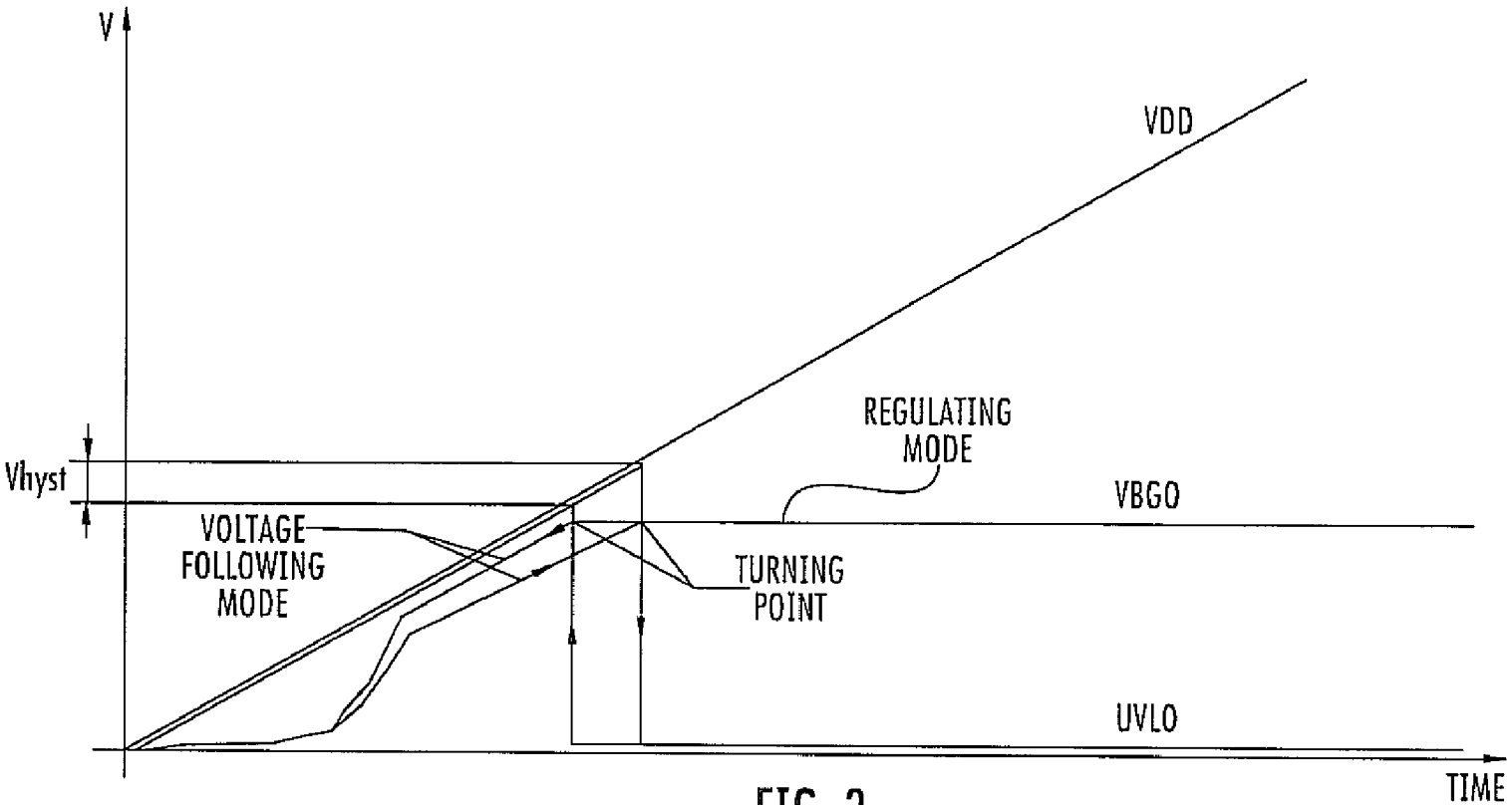
FIG. 3 is a time evolution graph illustrating waveforms representative of a reference signal, an output regulated reference voltage signal, and an under voltage lockout logic signal of the integrated electronic device of FIG. 1.

With reference to FIGS. 1 and 3, the functioning of the device 100 to provide the output regulated reference voltage signal OVBG and the under voltage lockout logic signal UVLO based upon a input signal, i.e. the first reference signal VDD (supply voltage) will now be described. The description of the functioning of the device 100 with reference to FIG. 3 is relative to the start-up phase of the device, i.e. the increasing in time of the supply voltage VDD from 0V to an operating supply voltage level, e.g. 5V (VDD up direction). The voltage divider block 102 sets the under voltage lockout logic signal threshold in VDD up direction, defined as follows:

$$V_{thUVLO\text{-}UP}=VBG\cdot(R1+R2+R3)/R3\cong 1.2\cdot(R1+R2+R3)/R3 \quad (1)$$

in which VBG is the natural bandgap voltage typically equal to 1.2 V.

The voltage divider block 102 also sets the under voltage lockout logic signal threshold in the VDD downward direction, i.e. during a shutdown phase of the device. Such under voltage lockout logic signal threshold in VDD down direction is defined as follows:

$$V_{thUVLO\text{-}DOWN}=VBG\cdot(R2+R3)/R3\cong 1.2\cdot(R2+R3)/R3 \quad (2)$$

in which VBG is the natural bandgap voltage typically equal to 1.2 V.

It should be noted that in this last case, the first resistor R1 is bypassed by the switch element 116 controlled by the inverter block 115 based upon the under voltage lockout logic signal UVLO. The input signal VDD (supply voltage) is led through the current limiter block 103 to the voltage divider block 102. The internal reference voltage signal VBGI provided by the voltage divider block 102 is led to the bandgap core module 106, the regulation element 111 and the buffer element 107.

Until the input signal VDD is below the under voltage lockout logic signal threshold in the VDD upward direction (in FIG. 3, from time t=0 to time t=tp), the internal reference voltage signal VBGI is proportional to the input signal VDD. The proportion between the input signal VDD and the internal reference voltage signal VBGI is given by the ratio of the voltage divider block 102 depending on the values of first resistor R1, second resistor R2, and third resistor R3. In this condition, the bandgap core module 106 and the operational amplifier 109 generate the driving signal ds, as a result of a preliminary processing of the internal reference voltage signal VBGI, to be provided to the regulation element. Until the input signal VDD is below the under voltage lockout logic signal threshold in the VDD upward direction (t=tp), the driving signal ds is such that the regulation element 111 drives no current, the current detection element 112 detects no current, providing to the under voltage lockout logic signal generation module 113 the control signal so that the under voltage lockout logic signal is high, representing the locked state of the integrated electronic device. It should be noted that during the time interval between time t=0 and time t=tp, the bandgap core group 104 (bandgap core module 106, operational amplifier 109, regulation element 111, current detection element 112, and under voltage lockout logic signal generation module 113) is arranged so that the integrated electronic device 100 operates as a voltage following circuit.

Once the input signal VDD reaches the under voltage lockout logic signal threshold in the VDD upward direction (represented by internal reference voltage signal VBGI equal to natural bandgap voltage), the bandgap core module 106 and the operational amplifier 109, in the preliminary processing of the internal reference voltage signal VBGI, by the driving signal ds, control the regulation element 107 to drive current from the node N (internal reference voltage signal VBGI) to regulate the voltage level of the node at the constant value. Thus, the output regulated reference voltage signal OVBG is substantially maintained to the level of the internal reference voltage signal VBGI (natural voltage level).

Furthermore, the current detection element 112 detects the current driven by the regulation element 111 and signals, by the control signal sc, to the under voltage lockout signal generation circuit, the change of the state from the lock state to the unlock state. In fact, the under voltage lockout logic signal UVLO goes to zero (low level) and unlocks the operation of the device 100. Thus, the output regulated reference voltage signal OVBG gets regulated. It should be noted that after the time t=tp, the bandgap core group 104 (bandgap core module 106, operational amplifier 109, regulation element 111, current detection element 112, and under voltage lockout logic signal generation module 113) is arranged so that the integrated electronic device 100 operates as a regulation circuit.

In view of the functioning mode described above, it should be noted that under the under voltage lockout logic signal turning point (0<t<tp), the device 100 is in voltage following mode: the under voltage lockout logic signal is following the input signal VDD; and the output regulated reference signal is increasing proportionally to the input signal VDD. At the under voltage lockout logic signal turning point, the device 100 goes from the voltage following mode to the regulation mode: the under voltage lockout logic signal goes to zero and the output regulated reference signal gets regulated.

The device 100 allows increased precision output regulated reference voltage generation in conjunction with under voltage lockout logic signal generation capability. It is based on a bandgap reference voltage, which assures a relatively high precision of reference levels independent on operating conditions and time.

In contrast to the conventional systems based on a separate bandgap reference voltage and UVLO circuit (usually containing another bandgap core), the device 100 includes a single bandgap core module used for both the output regulated reference voltage signal generation and the under voltage lockout logic signal generation.

In view of this, the main benefit of the new approach is a chip area savings. In fact, because the bandgap core components, particularly the bipolar junction transistors and the resistors (FIG. 2), occupy significant layout area, doubling of these components may be avoided.

The device comprises a bandgap core group including a bandgap core module connected in a feedback loop regulated by an operational amplifier and regulation element. The regulation element is connected between the internal reference voltage signal VBGI node and ground.

Thus, the bandgap core group can work in two modes: voltage following or regulating mode. If the OPAMP is in one or another mode depends on the voltage level connected to the bandgap structure. If the bandgap core group is connected to the supply voltage VDD directly, the bandgap core group enters the regulating mode at VDD level equal to the bandgap natural voltage. If the supply voltage VDD is connected to the bandgap core group through a voltage divider block, the regulation entrance level is increased in inverse proportion to the voltage divider block ratio.

The under voltage lockout logic signal function is based on distinguishing the bandgap core group operating mode. The current detection element is connected in the regulation element path. If there is no current flowing through the regulation element, the supply voltage level is not sufficient, and the under voltage lockout logic signal level is high. Once the current through the regulation element starts to flow (bandgap core group in the regulation mode), the under voltage lockout logic signal goes down (unlocks the system) signalizing sufficient level of the supply voltage VDD.

Very often the systems controlled by the UVLO signal are power systems. During the start-up phase they may cause a relatively large inrush current, and due to the input wires impedance, the supply voltage VDD may drop by a certain value. This may cause repeated under voltage lockout logic signal detection and possible oscillations. To reduce this effect, hysteresis is included in the under voltage lockout logic signal operation. This is performed by a positive feedback led from the first output terminal of the signal generation stage 101 of the device 100 to the input of the voltage divider block impacting its ratio.

To the above-described embodiments of the device, those of ordinary skill in the art, to meet contingent needs, will be able to make modifications, adaptations, and replacements of elements with functionally equivalent other ones, without departing from the scope of the following claims. Each of the characteristics described as belonging to a possible embodiment may be implemented regardless of the other embodiments described.

That which is claimed:

1. An electronic integrated device comprising:

a signal generation stage configured to generate a first signal representative of an under voltage signal, said signal generation stage comprising a bandgap core group, and a voltage divider block being configured to provide an internal reference voltage signal to said bandgap core group based upon a reference signal, said bandgap core group configured to generate the first signal based upon the internal reference voltage signal and further comprising a bandgap core module configured to process the internal reference voltage signal to generate a driving signal, a first generation module configured to generate an output regulated reference voltage signal based upon the internal reference voltage signal, and a second generation module configured to generate the first signal based upon the internal reference voltage signal and the driving signal.

2. The device according to claim 1, wherein the under voltage signal is an under voltage lockout logic signal.

3. The device according to claim 1, wherein said second generation module comprises an operational amplifier coupled to said bandgap core module, said operational amplifier having an output terminal and being configured to provide the driving signal on the output terminal.

4. The device according to claim 3, wherein said second generation module further comprises a compensation block coupled to said operational amplifier in a feedback loop configuration.

5. The device according to claim 3, wherein said second generation module further comprises a regulation element coupled to said operational amplifier and configured to receive the driving signal.

6. The device according to claim 5, wherein the second generation module further comprises a current detection element coupled to said regulation element, and wherein said regulation element, based upon the driving signal, is configured to enable a flow of current from a node having a voltage level corresponding to the internal reference voltage signal to a second reference signal through the current detection element.

7. The device according to claim 6, wherein the second generation module further comprises an under voltage signal generation module coupled to said current detection element, and wherein said current detection element, based upon current detected, is configured to provide a control signal to said under voltage signal generation module.

8. The device according to claim 7, wherein said under voltage signal generation module has an output terminal, and wherein said under voltage signal generation module, based upon the control signal, is configured to assume one of an unlocked state and a locked state having on the output terminal, one of a no-null voltage value and a null voltage value, respectively, corresponding to the first signal.

9. The device according to 8, wherein said signal generation stage further comprises a hysteresis module coupled between the output terminal of said under voltage signal generation module and said voltage divider block and configured to provide positive feedback.

10. The device according to claim 1, wherein said first generation module has an output terminal configured to provide the output regulated reference voltage signal, and wherein said first generation module further comprises a buffer element having an input terminal coupled to said voltage divider block and an output terminal corresponding to the output terminal of said first generation module.

11. A signal generator configured to generate a first signal representative of an under voltage signal, the signal generator comprising:

a bandgap core group; and a voltage divider block configured to provide an internal reference voltage signal to said bandgap core group based upon a reference signal;

said bandgap core group being configured to generate the first signal based upon the internal reference voltage signal and further comprising a bandgap core module configured to process the internal reference voltage signal to generate a driving signal, a first generation module configured to generate a output regulated reference voltage signal based upon the internal reference voltage signal, and a second generation module configured to generate the first signal based upon the internal reference voltage signal and the driving signal.

12. The signal generator according to claim 11, wherein the under voltage signal is an under voltage lockout logic signal.

13. The signal generator according to claim 11, wherein said second generation module comprises an operational amplifier coupled to said bandgap core module, said operational amplifier having an output terminal and being configured to provide the driving signal on the output terminal.

14. The signal generator according to claim 13, wherein said second generation module further comprises a compensation block coupled to said operational amplifier in a feedback loop configuration.

15. The signal generator according to claim 13, wherein said second generation module further comprises a regulation element coupled to said operational amplifier and configured to receive the driving signal.

16. The signal generator according to claim 15, wherein the second generation module further comprises a current detection element coupled to said regulation element, and wherein said regulation element, based upon the driving signal, is configured to enable a flow of current from a node having a voltage level corresponding to the internal reference voltage signal to a second reference signal through the current detection element.

17. The signal generator according to claim 16, wherein the second generation module further comprises an under voltage signal generation module coupled to said current detection element, and wherein said current detection element, based upon current detected, is configured to provide a control signal to said under voltage signal generation module.

18. The signal generator according to claim 17, wherein said under voltage signal generation module has an output terminal, and wherein said under voltage signal generation module, based upon the control signal, is configured to assume one of an unlocked state and a locked state having on the output terminal, one of a no-null voltage value and a null voltage value, respectively, corresponding to the first signal.

19. The signal generator according to claim 18, further comprising a hysteresis module coupled between the output terminal of said under voltage signal generation module and said voltage divider block and configured to provide positive feedback.

20. The signal generator according to claim 19, wherein said first generation module has an output terminal configured to provide the output regulated reference voltage signal, and wherein said first generation module further comprises a buffer element having an input terminal coupled to said voltage divider block and an output terminal corresponding to the output terminal of said first generation module.

21. A method of making an electronic integrated device comprising:

configuring a signal generation stage to generate a first signal representative of an under voltage signal, configuring the signal generation stage comprising providing a bandgap core group, and configuring a voltage divider block to provide an internal reference voltage signal to the bandgap core group based upon a reference signal, the bandgap core group being configured to generate the first signal based upon the internal reference voltage signal, configuring the bandgap core group comprising configuring a bandgap core module to process the internal reference voltage signal to generate a driving signal, configuring a first generation module to generate a output regulated reference voltage signal based upon the internal reference voltage signal, and configuring a second generation module to generate the first signal based upon the internal reference voltage signal and the driving signal.

22. The method according to claim 21, wherein the under voltage signal is an under voltage lockout logic signal.

23. The method according to claim 21, wherein configuring the second generation module comprises coupling an operational amplifier to the bandgap core module, the operational amplifier having an output terminal to provide the driving signal on the output terminal.

24. The method according to claim 23, wherein configuring the second generation module further comprises coupling a compensation block to the operational amplifier in a feedback loop configuration.

25. The method according to claim 23, wherein configuring the second generation module further comprises a coupling a regulation element coupled to the operational amplifier to receive the driving signal.

26. The method according to claim 25, wherein configuring the second generation module further comprises coupling a current detection element to the regulation element, and wherein the regulation element, based upon the driving signal, enables a flow of current from a node having a voltage level corresponding to the internal reference voltage signal to a second reference signal through the current detection element.

27. The method according to claim 26, wherein configuring the second generation module further comprises coupling an under voltage signal generation module to the current detection element, and wherein the current detection element, based upon current detected, provides a control signal to the under voltage signal.

* * * * *